US011293080B2

(12) United States Patent
Kim et al.

(10) Patent No.: US 11,293,080 B2
(45) Date of Patent: Apr. 5, 2022

(54) MAGNESIUM DIE CASTING ALLOY

(71) Applicants: Hyundai Motor Company, Seoul (KR); Kia Motors Corporation, Seoul (KR); SJ Tech Co., Ltd., Daegu (KR)

(72) Inventors: Byong-Soo Kim, Gyeonggi-do (KR); Jung-Mok Lee, Daegu (KR); Dong-Keun Lee, Daegu (KR); Il Huh, Seoul (KR)

(73) Assignees: Hyundai Motor Company, Seoul (KR); Kia Motors Corporation, Seoul (KR); SJ Tech Co., Ltd., Daegu (KR)

( * ) Notice: Subject to any disclaimer, the term of this patent is extended or adjusted under 35 U.S.C. 154(b) by 110 days.

(21) Appl. No.: 16/661,659

(22) Filed: Oct. 23, 2019

(65) Prior Publication Data

US 2020/0181742 A1 Jun. 11, 2020

(30) Foreign Application Priority Data

Dec. 7, 2018 (KR) ..... 10-2018-0157620

(51) Int. Cl.
*C22C 23/02* (2006.01)

(52) U.S. Cl.
CPC ..... *C22C 23/02* (2013.01)

(58) Field of Classification Search
CPC . C22F 1/06; C22C 23/00; C22C 23/04; C22C 23/02
See application file for complete search history.

(56) References Cited

FOREIGN PATENT DOCUMENTS

| | | | |
|---|---|---|---|
| CN | 105779838 | A | 7/2016 |
| KR | 10-2015-0065203 | A | 6/2015 |
| KR | 10-2015-0124212 | A | 11/2015 |
| KR | 101732595 | B1 | 5/2017 |
| WO | 2017/068332 | A1 | 4/2017 |

OTHER PUBLICATIONS

Ghali, Edward, Wolfgang Dietzel, and Karl-Ulrich Kainer. "General and localized corrosion of magnesium alloys: a critical review." Journal of materials engineering and performance 13.1 (2004): 7-23.*

* cited by examiner

*Primary Examiner* — Jessee R Roe
(74) *Attorney, Agent, or Firm* — Mintz Levin Cohn Ferris Glovsky and Popeo, P.C.; Peter F. Coriess

(57) ABSTRACT

Disclosed are a magnesium die casting alloy, and an alloy composition for improving thermal conductivity and electrical conductivity. A magnesium die casting alloy includes an amount of about 0.5 to 2.0 wt % of aluminum (Al) and the balance magnesium (Mg), based on the total weight of the magnesium die casting alloy. Accordingly, an alloy, which has high thermal conductivity and electrical conductivity as compared to a conventional AZ91D magnesium alloy, is obtained.

3 Claims, 3 Drawing Sheets

MAGNESIUM DIE CASTING ALLOY

CROSS-REFERENCE TO RELATED APPLICATIONS

This application claims priority under 35 U.S.C. § 119 to Korean Patent Application No. 10-2018-0157620, filed on Dec. 7, 2018, in the Korean Intellectual Property Office, the disclosure of which is incorporated herein by reference in its entirety.

TECHNICAL FIELD

The present invention relates to a magnesium die casting alloy, and an alloy composition thereof for improving thermal conductivity and electrical conductivity.

BACKGROUND

A magnesium alloy generally has excellent mechanical characteristics, but has a light metal structure. However, it is difficult to use a conventional AZ91D magnesium alloy as an automotive electronic part due to, for example, low thermal conductivity (50 to 60 W/mK), low electrical conductivity (10 to 12% IACS), and the like. It is also difficult to use a commercially available magnesium alloy AM60 having a thermal conductivity within 60 W/mK as an automotive electronic part.

In order to alleviate these difficulties, in the related field, aluminum (Al) has not been added to a magnesium alloy, or calcium (Ca) or a rare earth element, and the like has been further added to the magnesium alloy even though aluminum (Al) is added to the magnesium alloy. However, the magnesium alloys still have a problem in that price competitiveness is low and it is difficult to recycle the magnesium alloy because a rare earth element is used.

SUMMARY OF THE INVENTION

In preferred aspects, provided is an alloy which may have substantially improved thermal conductivity and electrical conductivity as compared to a conventional AZ91D magnesium alloy. The alloy may also have excellent corrosion resistance as compared to a conventional AZ91D magnesium alloy. In addition, price competitiveness may be secured by not using an expensive rare earth element and instead, by adding an element which may be universally used.

In an aspect, provided is a magnesium die casting alloy that may suitably include an amount of about 0.5 to 2.0 wt % of aluminum (Al) and the balance magnesium (Mg). All the wt % are based on the total weight of the magnesium die casting alloy.

The term "magnesium die casting alloy" as used herein refers to an alloy including magnesium (Mg) as a main component, which may constitute the alloy composition in an amount greater than about 85 wt %, 86 wt %, 87 wt %, 88 wt %, 89 wt %, 90 wt %, 91 wt %, 92 wt %, 93 wt %, 94 wt %, 95 wt %, 96 wt %, 97 wt %, 98 wt %, or 99 wt %, based on the total weight of the alloy composition. In certain embodiments, the magnesium die casting alloy may further contain aluminum, zinc, manganese, silicon, copper, rare earth elements, zirconium and the like for improve some fundamental properties of the alloy.

Preferably, the magnesium die casting alloy may further suitably include an amount of about 0.1 to 0.2 wt % of silicon (Si), an amount of about 0.15 wt % or less of manganese (Mn), an amount of about 1 to 3 wt % of zinc (Zn), and an amount of about 0.1 to 0.15 wt % of tin (Sn), based on the total weight of the magnesium die casting alloy.

Preferably, a ratio of tin (Sn)/silicon (Si) may suitably be of about 0.5 to 1.5.

Preferably, a corrosion rate may be of about 4 mg/cm$^2$/day or less.

Preferably, the present invention may further suitably include an amount of about 0.5 wt % or less of copper (Cu) based on the total weight of the magnesium die casting alloy.

Further provided herein is the magnesium die casting alloy that may consist essentially of, essentially consist of, or consist of the components as disclosed herein. For instance, the magnesium die casting alloy may consist essentially of, essentially consist of, or consist of: an amount of about 0.5 to 2.0 wt % of aluminum (Al); an amount of about 0.1 to 0.2 wt % of silicon (Si); an amount of about 0.15 wt % or less of manganese (Mn); an amount of about 1 to 3 wt % of zinc (Zn); an amount of about 0.1 to 0.15 wt % of tin (Sn); and the balance magnesium (Mg), all the wt % based on the total weight of the magnesium die casting alloy. Further, the magnesium die casting alloy may consist essentially of, essentially consist of, or consist of: an amount of about 0.5 to 2.0 wt % of aluminum (Al); an amount of about 0.1 to 0.2 wt % of silicon (Si); an amount of about 0.15 wt % or less of manganese (Mn); an amount of about 1 to 3 wt % of zinc (Zn); an amount of about 0.1 to 0.15 wt % of tin (Sn); an amount of about 0.5 wt % or less of copper (Cu); and the balance magnesium (Mg), all the wt % based on the total weight of the magnesium die casting alloy.

Further provided is an automotive electronic part including the magnesium die casting alloy as described herein.

Still further provided is a vehicle including the automotive electronic part as described herein. According to various exemplary embodiments of the present invention, the magnesium die casting alloy may obtain substantially improved thermal conductivity and electrical conductivity as compared to a conventional AZ91D magnesium alloy. In addition, the magnesium die casting alloy may obtain substantially improved corrosion resistance as compared to the AZ91D magnesium alloy. Moreover, price competitiveness may be secured by not adding an expensive rare earth element and by adding an element which may be universally used.

DETAILED DESCRIPTION OF THE EMBODIMENTS

Figure 1:
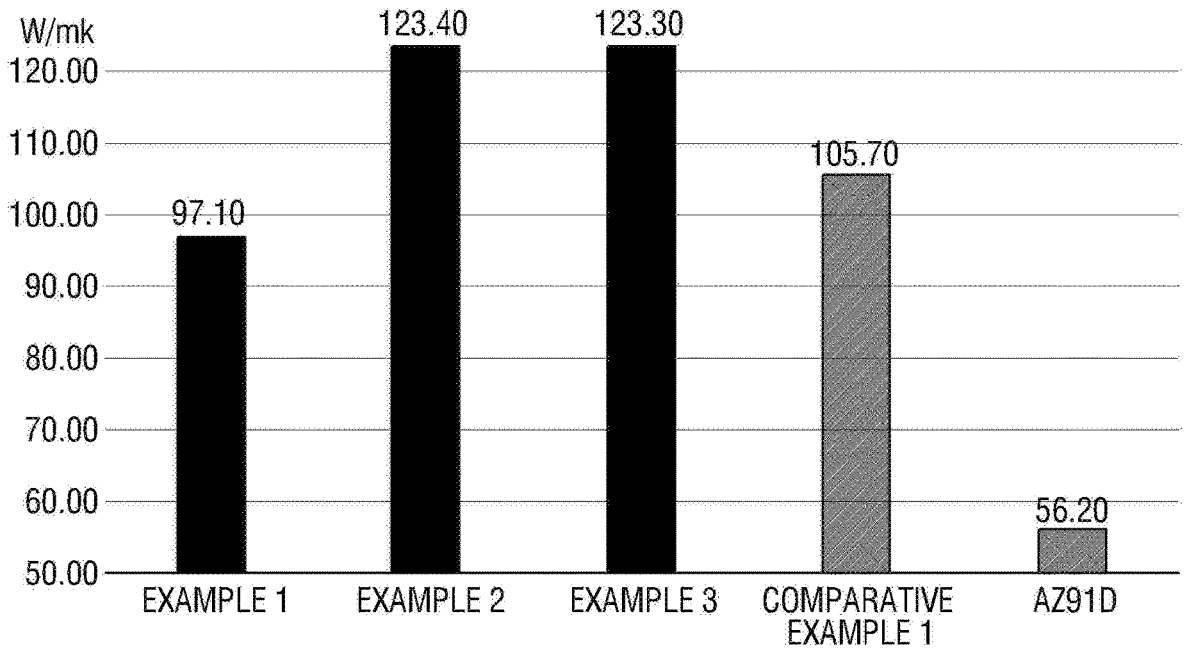
FIG. 1 shows a graph comparing thermal conductivities of Examples 1 to 3, Comparative Example 1, and a conventional AZ91D magnesium alloy.

Hereinafter, the present invention will be described in detail. However, the present invention is not limited or restricted by exemplary embodiments, objects and effects of the present invention will be naturally understood or become apparent from the following description, and the objects and effects of the present invention are not limited by only the following description. Further, in the description of the present invention, when it is determined that the detailed description for the publicly-known technology related to the present invention can unnecessarily obscure the gist of the present invention, the detailed description thereof will be omitted.

As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

In the present specification, it will be understood that when a range is described for a variable, the variable includes all values within the stated range including the end points described in the range. For example, it will be understood that a range of "5 to 10" includes any sub-ranges, such as 6 to 10, 7 to 10, 6 to 9, 7 to 9, etc., as well as values of 5, 6, 7, 8, 9, and 10, and also includes any value between integers that are valid within the scope of the stated ranges such as 5.5, 6.5, 7.5, 5.5 to 8.5, and 6.5 to 9, etc. In addition, for example, it will be understood that a range of "10% to 30%" includes any sub-ranges such as 10% to 15%, 12% to 18%, 20% to 30%, etc., as well as all integers including values of 10%, 11%, 12%, 13%, etc. and 30%, and also includes any value between integers that are valid within the scope of the stated range such as 10.5%, 15.5%, 25.5%, etc.

In one preferred aspect, provided is a magnesium dies casting alloy. The magnesium dies casting alloy may include an amount of about 0.5 to 2.0 wt % of aluminum (Al) and the balance magnesium (Mg). All the wt % are based on the total weight of the magnesium dies casting alloy. The magnesium dies casting alloy may further include an amount of about 0.1 to 0.2 wt % of silicon (Si), an amount of about 0.15 wt % or less of manganese (Mn), an amount of about 1 to 3 wt % of zinc (Zn), and an amount of about 0.1 to 0.15 wt % of tin (Sn), and may further include an amount of about 0.5 wt % or less of copper (Cu).

TABLE 1

| | Main composition (wt %) | | | | | | |
|---|---|---|---|---|---|---|---|
| Classification | Mg | Al | Si | Cu | Mn | Zn | Sn |
| Example | Bal. | 0.5-2.0 | 0.1-0.2 | 0.5 or less | 0.15 or less | 1-3 | 0.1-0.15 |
| Comparative Example | Bal. | 8.3-9.7 | 0.1 or less | 0.03 | 0.15-0.50 | 0.35-1.0 | — |

TABLE 2

| Classification | Thermal conductivity | Electrical conductivity |
|---|---|---|
| Example | 95 w/mK or greater | 22% IACS or greater |
| Comparative Example | 56 w/mK | 12% IACS |

Table 1 shows the compositions of an exemplary magnesium die casting alloy according to an exemplary embodiment of the present invention and that of a magnesium die casting alloy in the related art. Table 2 shows thermal conductivities and electrical conductivities of the exemplary magnesium die casting alloys according to an exemplary embodiment of the present invention and the magnesium dies casting alloy in the related art.

As shown in Tables 1 and 2, unlike a magnesium die casting alloy in the related art, in the exemplary magnesium dies casting alloy, amounts of aluminum (Al) and manganese (Mn) added may be decreased, amounts of silicon (Si), copper (Cu), and zinc (Zn) added may be increased, and tin (Sn), which is not added in the related art, may be included. According to the exemplary embodiment of the present invention, the composition of the magnesium dies casting alloy may have not only substantially increased thermal conductivity but also substantially increased electrical conductivity.

The reason for controlling the type and composition range of alloy element to be added to the present invention is as follows.

(1) Aluminum (Al) in an Amount of about 0.5 to 2.0 wt %

Aluminum as used herein may increase strength and improve castability, for example, when aluminum is added to an alloy, thermal conductivity of the alloy is decreased. Preferably, at least an amount of about 0.5 wt % of aluminum may be added to increase thermal conductivity of an alloy and implement moldability of a die casting, and an amount of about 2.0 wt % or less of aluminum, particularly, an amount of about 1.7 wt % or less of aluminum may be added to prevent thermal conductivity from being rapidly decreased.

(2) Silicon (Si) in an Amount of about 0.1 to 0.2 wt %

Silicon as used herein may improve corrosion resistance, increase strength, and improve castability. In order to improve corrosion resistance, and the like, an amount of about 0.1 wt % or greater of silicon may be added, but an amount of about 0.2 wt % or less of silicon may be added to prevent cracking during molding.

(3) Copper (Cu) in an Amount of about 0.5 wt % or Less

Copper as used herein may increase strength. When copper in an amount greater than about 0.5 wt % of is added, corrosion resistance may be rapidly decreased, such that a corrosion rate may be rapidly increased. Preferably, an amount of about 0.5 wt % or less of copper may be added.

(4) Manganese (Mn) in an Amount of about 0.15 wt % or Less

Manganese as used herein may improve corrosion resistance. When an amount of greater than about 0.15 wt % of manganese is added, a cracking phenomenon may occur during molding, so that it is preferred that 0.15 wt % or less of manganese is added.

(5) Zinc (Zn) in an Amount of about 1 to 3 wt %

Zinc as used herein may improve corrosion resistance, increase strength, and improve castability, and an amount of about 1 wt % or greater of zinc may be added to implement the above-described characteristics, and an amount of about 3 wt % or less of zinc may be added to decrease thermal conductivity and prevent a cracking phenomenon during molding.

(6) Tin (Sn) in an Amount of about 0.1 to 0.15 wt %

Tin as used herein may improve corrosion resistance and improve stretching. Preferably, an amount of about 0.1 wt % or greater of tin may be added to implement the above-described characteristics, and an amount of about 0.15 wt % or less of tin may be added to prevent thermal conductivity from being decreased.

As other elements, calcium (Ca), beryllium (Be), or inevitable impurities may be included.

Meanwhile, according to various exemplary embodiments of the present invention, the magnesium die casting alloy may have a corrosion rate at a level less than or equivalent to the corrosion rate of the conventional magnesium alloy AZ91D by adjusting the amounts of silicon (Si), manganese (Mn), zinc (Zn), and tin (Sn) added, particularly, the amounts of tin (Sn) and silicon (Si) added to reduce the corrosion rate. Particularly, a ratio of tin (Sn)/silicon (Si) may range from about 0.5 to about 1.5.

The ratio of tin (Sn)/silicon (Si) may be a ratio of a tin content (wt %) to a silicon content (wt %) to be included in a magnesium die casting alloy. When the ratio of tin (Sn)/silicon (Si) is greater than about 1.5, the corrosion rate may be greater than 4.0 mg/cm$^2$/day. Thus, the ratio may be suitably controlled to be of about 0.5 to 1.5.

For example, as the potential difference according to the ratio of tin (Sn)/silicon (Si) is analyzed, the potential difference when the ratio of tin (Sn)/silicon (Si) may be controlled to be of about 0.5 to 1.5 is less than the potential difference when the ratio is greater than 1.5, which may be related to the change in size of a crystal grain system.

EXAMPLE

Hereinafter, various examples of the present invention will be described in detail. However, the Examples described below are only provided for specifically exemplifying or explaining the present invention, and the present invention is not limited thereby.

TABLE 3

| | Main composition (wt %) | | | | | | |
|---|---|---|---|---|---|---|---|
| Classification | Mg | Al | Si | Cu | Mn | Zn | Sn |
| Example 1 | Bal | 1.7 | 0.18 | 0.5 | 0.1 | 2 | 0.15 |
| Example 2 | Bal | 1.0 | 0.15 | 0.3 | 0.1 | 1.5 | 0.15 |
| Example 3 | Bal | 0.5 | 0.1 | 0.1 | 0.1 | 3 | 0.15 |
| Comparative Example 1 | Bal | 2.0 | 0.15 | 1.5 | 0.1 | 3 | 0.15 |
| AZ91D | 89.6 | 9 | 1.0 | 0.15 | 0.03 | 0.005 | 0.03 |

TABLE 4

| Classification | Thermal conductivity (W/mK) | Electrical conductivity (% IACS) | Corrosion rate (mg/cm$^2$/day) |
|---|---|---|---|
| Example 1 | 97.1 | 22.9 | 2.65 |
| Example 2 | 123.4 | 27.4 | 1.22 |
| Example 3 | 123.3 | 27.6 | 2.75 |
| Comparative Example 1 | 105.7 | 24.2 | 13.96 |
| AZ91D | 56.2 | 10.1 | 3.49 |

Table 3 shows compositions of the Examples according to various exemplary embodiments of the present invention and the Comparative Examples of a conventional magnesium alloy AZ91D. Table 4 shows the thermal conductivities, electrical conductivities, and corrosion rates measured from the Examples according to the composition in Table 3 and the AZ91D.

Figure 2:
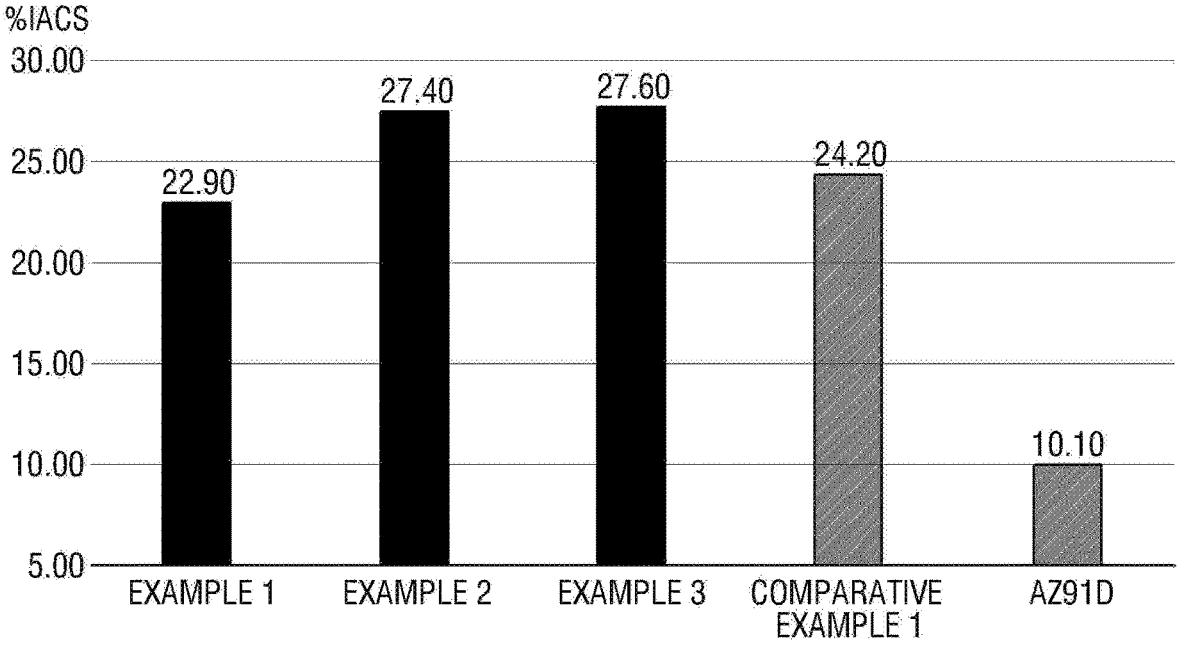
FIG. 2 shows a graph comparing electrical conductivities of Examples 1 to 3, Comparative Example 1, and a conventional magnesium alloy AZ91D.
Figure 3:
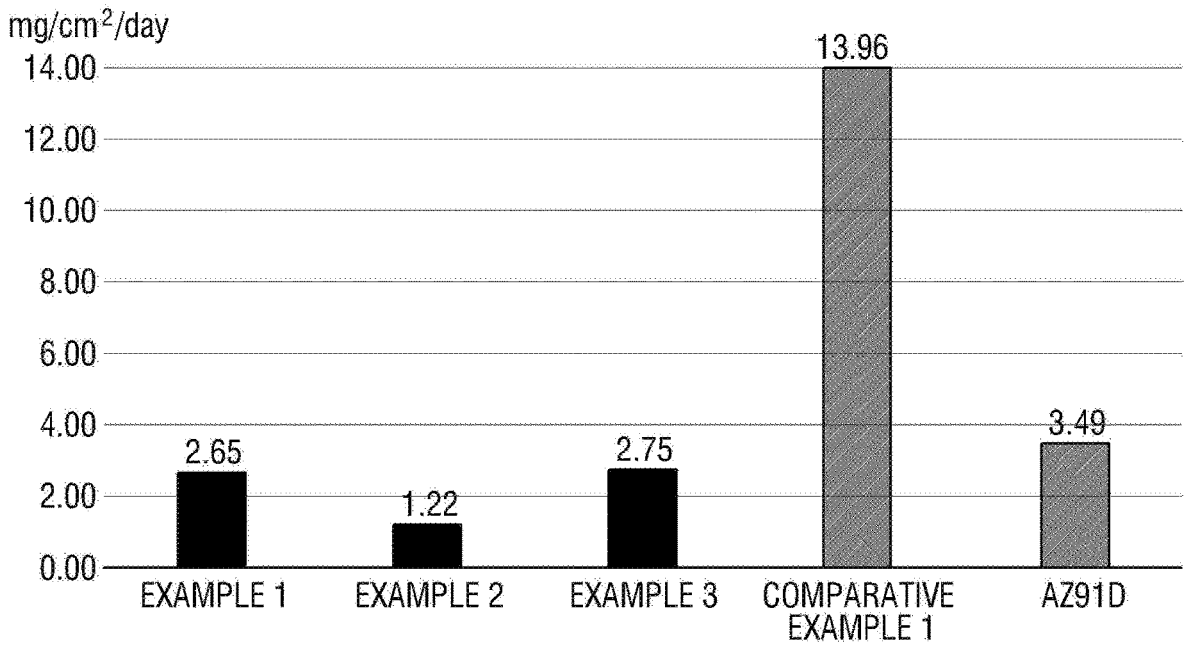
FIG. 3 shows a graph comparing corrosion rates of Examples 1 to 3, Comparative Example 1, and a conventional magnesium alloy AZ91D.

FIG. 1 shows a graph comparing thermal conductivities of Examples 1 to 3, Comparative Example 1, and a commercially available magnesium alloy AZ91D. FIG. 2 shows a graph comparing electrical conductivities of Examples 1 to 3, Comparative Example 1, and a commercially available magnesium alloy AZ91D. FIG. 3 shows a graph comparing corrosion rates of Examples 1 to 3, Comparative Example 1, and a commercially available magnesium alloy AZ91D. The measurement process and measurement method of the thermal conductivity, electrical conductivity, and corrosion rate are as follows.

Herein below shows examples or samples for measuring thermal conductivity, measuring electrical conductivity, and measuring a corrosion rate after manufacturing process such as melting alloy elements in a magnesium melt bath, stabilizing the magnesium melt bath in which the alloy elements are molten, and preparing a magnesium alloy ingot.

The thermal conductivity was measured according to the ASTM E 1461 test method, and after a sample was processed to a predetermined thickness, thermal diffusivity, specific heat, and thermal conductivity were measured by using a Flash method, and the electrical conductivity was measured according to the ASTM E 1004 test method, and after a sample was processed into a predetermined shape, % IACS was measured by using an Electromagnet method. The thermal conductivity and electrical conductivity were measured at room temperature. The corrosion rate was measured according to the ASTM B 117 test method, and after a sample was processed into a predetermined shape, NaCl 5%—24H saline was sprayed onto the sample to measure the corrosion rate through a difference in weight (mg) before and after the spray.

As shown in Tables 3 and 4 and FIGS. 1 to 3, a thermal conductivity of approximately 100 W/mK or greater was exhibited as 0.5 to 2.0 wt % of Al was added in Examples 1 to 3 and Comparative Example 1. The thermal conductivity of Examples, i.e. 100 W/mK or greater, was improved from a thermal conductivity of the magnesium alloy AZ91D, i.e., 56.2 W/mK, to which 9 wt % of Al was added.

As the ratio of tin (Sn)/silicon (Si) was controlled to 0.83, 1, and 1.5 in Examples 1 to 3, respectively, a corrosion rate of 4.0 mg/cm$^2$/day or less was exhibited. The ratio of tin (Sn)/silicon (Si) was 1 in Comparative Example 1, but as the amount of copper (Cu) added was greater than 0.5 wt %, and then a corrosion rate of 13.96 mg/cm$^2$/day was exhibited. Accordingly, it can be seen that the control of the corrosion rate may be related to not only the ratio of tin (Sn)/silicon (Si), but also the amount of copper (Cu) added.

Meanwhile, the corrosion rates in Examples 1 to 3 were shown to be less than the corrosion rate of the conventional magnesium alloy AZ91D. According to an exemplary embodiment of the present invention, it can be seen that the corrosion rates in Examples 1 to 3 were less than the corrosion rate of the conventional magnesium alloy AZ91D.

TABLE 5

| Classification | Main composition (wt %) Al | Zn | Mn | Cu | Sn | Si | Ratio of Sn/Si | Evaluation Corrosion rate (mg/cm$^2$/day) |
|---|---|---|---|---|---|---|---|---|
| Example 4 | 0.50 | 3.00 | 0.1 | 0.50 | 0.1 | 0.2 | 0.5 | 4.0 |
| Example 5 | 0.50 | 3.00 | 0.1 | 0.50 | 0.12 | 0.2 | 0.6 | 3.0 |
| Example 6 | 0.50 | 3.00 | 0.1 | 0.50 | 0.15 | 0.2 | 0.75 | 4.0 |
| Comparative Example 2 | 0.50 | 3.00 | 0.1 | 0.50 | 0.05 | 0.02 | 2.5 | 6.5 |
| Comparative Example 3 | 0.50 | 3.00 | 0.1 | 0.50 | — | — | — | 5.7 |
| Comparative Example 4 | 0.50 | 3.00 | 0.1 | 0.50 | — | 0.1 | — | 5.8 |
| Comparative Example 5 | 0.50 | 3.00 | 0.1 | 0.50 | — | 0.2 | — | 5.5 |
| Comparative Example 6 | 1.00 | 3.00 | 0.1 | 0.50 | — | — | — | 5.7 |
| Comparative Example 7 | 1.00 | 3.00 | 0.1 | 0.50 | — | 0.2 | — | 5.7 |

Table 5 shows a change in corrosion rate according to the ratio of tin (Sn)/silicon (Si). The ratios of tin (Sn)/silicon (Si) in Examples 4 to 6 were 0.5 to 0.75, the ratio of tin (Sn)/silicon (Si) in Comparative Example 2 was 2.5, and Comparative Examples 3 to 7 were comparative examples in which tin (Sn) or silicon (Si) was not included.

As shown in Table 5, the corrosion rates in Examples 4 to 6 were shown to be 4.0 mg/cm$^2$/day or less, and the corrosion rate in Comparative Example 2 was 6.5 mg/cm$^2$/day, which was shown to be larger than those in Comparative Examples 3 to 7. Accordingly, it can be seen that when tin (Sn) and silicon (Si) are added together to decrease the corrosion rate, the ratio of tin (Sn)/silicon (Si) was controlled to be 0.5 to 1.5, and in the other cases, the corrosion rate was shown to be greater than the corrosion rate in the case where either tin (Sn) or silicon (Si) was selected and added.

According to various exemplary embodiments of the present invention, the magnesium die casting alloy may be applied to various electronic parts to which the existing AZ91D material fails to be applied, due to increased thermal conductivity and electrical conductivity by about 40% or greater as compared to the conventional magnesium alloy AZ91D without using a rare earth element, a fine metal, or the like.

The present invention has been described in detail through representative Examples, but it is to be understood by a person with ordinary skill in the art to which the present invention pertains that various modifications are possible in the above-described Examples within the range not departing from the scope of the present invention. Therefore, the scope of the present invention should not be limited to the above-described Examples but should be determined by not only the claims to be described below but also all the changes or modified forms derived from the claims and the equivalent concept thereof.

What is claimed is:

1. A magnesium die casting alloy comprising an amount of 0.5 to 2.0 wt % of aluminum (Al), 0.1 to 0.2 wt % of silicon (Si), an amount of 0.15 wt % or less of manganese (Mn), an amount of 1 to 3 wt % of zinc (Zn), an amount of 0.1 to 0.15 wt % of tin (Sn), 0.5 wt % or less of copper (Cu) and the balance magnesium (Mg), all the wt % based on the total weight of the magnesium die casting alloy, wherein a ratio of tin (Sn)/silicon (Si) is of 0.5 to 1.5, and wherein a corrosion rate is of 4 mg/cm$^2$/day or less.

2. An automotive electronic part comprising a magnesium die casting alloy of claim 1.

3. A vehicle comprising an automotive electronic part of claim 2.

* * * * *